US010557247B2

(12) United States Patent
Earhart et al.

(10) Patent No.: US 10,557,247 B2
(45) Date of Patent: Feb. 11, 2020

(54) REINFORCEMENT UNIT AND METHODS FOR CREATING A FOOTING FOR SUPPORTING A STRUCTURE

(71) Applicant: Glen Raven, Inc., Glen Raven, NC (US)

(72) Inventors: Robert Charles Earhart, Mebane, NC (US); Matthew Landon Clark, Whitsett, NC (US)

(73) Assignee: Glen Raven, Inc., Glen Raven, NC (US)

( * ) Notice: Subject to any disclaimer, the term of this patent is extended or adjusted under 35 U.S.C. 154(b) by 168 days.

(21) Appl. No.: 15/685,354

(22) Filed: Aug. 24, 2017

(65) Prior Publication Data

US 2018/0327995 A1 Nov. 15, 2018

Related U.S. Application Data

(60) Provisional application No. 62/506,030, filed on May 15, 2017.

(51) Int. Cl.
*E02D 27/00* (2006.01)
*E02D 27/42* (2006.01)
(Continued)

(52) U.S. Cl.
CPC ..... *E02D 27/42* (2013.01); *E04H 12/22* (2013.01); *E04H 12/2269* (2013.01);
(Continued)

(58) Field of Classification Search
CPC ..... E02D 27/42; E02D 27/00; E02D 27/08; E02D 27/16; E02D 2300/0053;
(Continued)

(56) References Cited

U.S. PATENT DOCUMENTS 3,598,065 A * 8/1971 Young ..... B65D 19/0028 108/3
3,611,952 A * 10/1971 Hoffman ..... B65D 19/004 108/11
(Continued)

FOREIGN PATENT DOCUMENTS

JP 2000-282714 A 10/2000
JP 2002357019 A 12/2002

OTHER PUBLICATIONS

International Search Report and Written Opinion of the International Searching Authority, International Application No. PCT/US2018/031134, dated Sep. 27, 2018, 12 pp.

*Primary Examiner* — Chi Q Nguyen
(74) *Attorney, Agent, or Firm* — Myers Bigel, P.A.

(57) ABSTRACT

A reinforcement unit and methods are provided for creating footings for supporting structures, such as a fence post, using a reinforcement unit that has a tower that is generally perpendicular to a base, the tower defining a cavity for receiving a portion of the structure and an anchoring material. The reinforcement unit can include a top portion of a tower that is frangible. The base of the reinforcement unit can further include a pocket (or similar recess) substantially similar in width or diameter to the top portion of the tower such that a second identical reinforcement unit can be inverted and stacked on top of the second reinforcement unit. The methods can include placing the reinforcement unit on a layer of backfill material behind the wall face so that the unit is located adjacent the wall face and the base of the reinforcement unit extends away from the wall face, covering the base with at least one other layer of the backfill material, fracturing the top portion from the tower, such that the top portion drops into the cavity of the tower, depositing a bottom portion of the structure in the cavity of the tower, and filling the cavity of the tower with an anchoring material.

8 Claims, 8 Drawing Sheets

(51) Int. Cl.
*E04H 12/22* (2006.01)
*E04H 17/22* (2006.01)
*E04H 17/08* (2006.01)

(52) U.S. Cl.
CPC ..... *E04H 17/08* (2013.01); *E04H 17/22* (2013.01); *E02D 2300/0007* (2013.01); *E02D 2300/0053* (2013.01)

(58) Field of Classification Search
CPC .... E02D 2300/0059; E02D 2300/0007; E02D 2300/001; E04H 12/22; E04H 12/2253; E04H 12/2238; E04H 12/2269
USPC ..... 52/297, 155, 704, 292, 296, 298; 248/507, 530
See application file for complete search history.

(56) References Cited

U.S. PATENT DOCUMENTS 3,699,901 A * 10/1972 Cook, III ..... B65D 19/004 108/55.5
5,755,162 A * 5/1998 Knight ..... B65D 19/0012 108/53.1
6,802,668 B2 * 10/2004 Parker ..... E02D 31/02 405/49
7,549,259 B2 6/2009 Calle
7,562,502 B2 7/2009 Calle
7,874,122 B2 1/2011 Calle
7,987,797 B2 * 8/2011 Stahl ..... B65D 19/004 108/53.3
8,162,668 B2 * 4/2012 Toly ..... G09B 23/30 434/262
8,708,304 B2 * 4/2014 Dysinger ..... A47B 91/005 108/51.11
2002/0017225 A1 * 2/2002 Koefelda ..... B65D 19/0018 108/53.3
2003/0200708 A1 * 10/2003 Parker ..... E02B 11/00 52/169.5
2011/0061321 A1 * 3/2011 Phuly ..... E02D 27/42 52/297
2012/0255624 A1 * 10/2012 Canney ..... E02B 11/005 137/315.01
2014/0231737 A1 8/2014 Whiteley
2014/0291221 A1 * 10/2014 Adams ..... E03F 1/005 210/170.03
2017/0022730 A1 1/2017 Mansueto
2017/0030104 A1 2/2017 Sinclair

* cited by examiner

REINFORCEMENT UNIT AND METHODS FOR CREATING A FOOTING FOR SUPPORTING A STRUCTURE

RELATED APPLICATION

The present application claims priority from and the benefit of U.S. Provisional Patent Application No. 62/506,030, filed May 15, 2017, the disclosure of which is hereby incorporated by reference herein in its entirety.

FIELD OF THE INVENTION

The present invention is directed to a reinforcement unit and methods for creating footings for supporting structures such as fence posts.

BACKGROUND OF THE INVENTION

Segmental retaining walls are commonly used in both residential and commercial applications to create usable real estate. Fencing is often required behind such walls to reduce the potential for falls and other potential hazards. In addition, guardrails usually are required in applications where parking lots or roadways are located near top of the wall.

Fence posts typically are mounted using concrete footings. A concrete footing can be created by digging a cavity in the ground, placing a bottom portion of the fence post in the cavity, and pouring concrete into the cavity.

Segmental retaining walls often include a reinforcing tie back system. For example, multiple layers of geosynthetic soil reinforcing material (commonly referred to as "geogrid") can be secured to the wall face so that the layers extend horizontally into the surrounding stone or soil. The interaction between the stone or soil and the reinforcing material can help to stabilize the wall face, i.e., the portion of the wall formed by stacked concrete blocks.

Digging a cavity for a fence post footing near a segmental retaining wall, after the reinforcing material has been installed, can necessitate drilling through the reinforcing material. Drilling through the reinforcing material can adversely affect the integrity of the reinforcing material, and therefore is undesirable. Hence, the cavities for fence posts located near segmental retaining walls are usually created as the wall is constructed.

In one approach, fence post cavities can be created using cylindrical cardboard forms. These forms usually are provided in relatively long lengths, and therefore must be cut to a desired length at the installation site. The form is placed on the backfill material (typically soil) used behind that wall, as the backfill material reaches a predetermined height. The predetermined height is chosen so that the top of the form is exposed from above ground after the wall has been completed, and all backfill material has been introduced and compacted. The form defines an open cavity in the ground that can receive the fence post.

The soil used as backfill material is usually kept moist, to help to achieve maximum density during compacting. Cardboard forms can be adversely affected by such moisture. Moisture from precipitation also can affect the integrity of a cardboard form. Also, the loads on the cardboard form resulting from the compacted backfill material, if excessive, can cause the form to collapse.

Alternatively, the form used to create the cavity can be created by cutting a predetermined length of polyvinyl chloride (PVC) or high-density polyethylene (HDPE) pipe. These materials are usually delivered to the installation site in ten or twenty-foot lengths. The need to cut the pipe creates an additional step in the construction process for the wall. Moreover, installers often cut the pipe using concrete demolition saws, chain saws, and other tooling not made for this particular use, thereby creating a potential safety hazard.

The cavity defined by the form creates a potential for injuries resulting from tripping over or stepping into an open hole in the ground. Moreover, the open cavity can fill with dirt and other debris, particularly in installations where fence posts will not be installed immediately after completion of the segmental retaining wall.

To reduce some of these potential issues, prior footing designs include a cover that protects the cavity. However, the cover must be removed prior to the fence post being installed. One example is discussed in U.S. Pat. No. 7,874,122 to Calle, the disclosures of which is hereby incorporated herein by reference. These covers are constantly lost on jobsites and/or create unwanted waste once removed.

A more efficient design for packaging, shipping and storage is also desired.

SUMMARY OF THE INVENTION

As a first aspect, embodiments of the present invention are directed to a reinforcement unit for creating a footing for supporting a structure, comprising: a base extending in a first direction; and a tower extending in a second direction from a first end of the base that is generally perpendicular to said base, a top portion of the tower having a width or a diameter smaller than the width or diameter of a bottom portion of the tower, the tower defining a cavity for receiving a portion of the structure and an anchoring material, wherein the portion of the structure is inserted into the cavity by way of a top of the cavity, and a width or a diameter of the top of the cavity is substantially greater than the outer dimensions of the portion of the structure so that the anchoring material can be introduced into the cavity by way of the top of the cavity while the portion of the structure is positioned within the cavity, wherein a second end of the base comprises a pocket substantially similar in width or diameter to the top portion of the tower such that a second identical reinforcement unit can be inverted and stacked on top of the reinforcement unit.

As a second aspect, embodiments of the present invention are directed to a reinforcement unit for creating a footing for supporting a structure, comprising: a base extending in a first direction; and a tower extending in a second direction from a first end of the base that is generally perpendicular to the base, a top portion of the tower having a width or a diameter smaller than the width or diameter of a bottom portion of the tower, the tower defining a cavity for receiving a portion of the structure and an anchoring material, wherein the portion of the structure is inserted into the cavity by way of a top of the cavity, and a width or a diameter of the top of the cavity is substantially greater than the outer dimensions of the portion of the structure so that the anchoring material can be introduced into the cavity by way of the top of the cavity while the portion of the structure is positioned within the cavity, and wherein the top portion of the tower comprises a frangible section.

As a third aspect, embodiments of the present invention are directed to a method for creating a footing for supporting a structure using a reinforcement unit comprising a tower that is generally perpendicular to a base, the tower defining a cavity for receiving a portion of the structure and an anchoring material, and wherein a top portion of the tower comprises a frangible section, the method comprising: placing the reinforcement unit on a layer of backfill material behind a wall face so that the tower is located adjacent the wall face and the base extends away from the wall face; covering the base of the reinforcement unit with at least one other layer of the backfill material; fracturing the top portion from the tower, such that the top portion drops into the cavity of the tower; depositing a bottom portion of the structure into the cavity of the tower; and filling the cavity of the tower with an anchoring material.

DETAILED DESCRIPTION OF THE INVENTION

Figure 1:
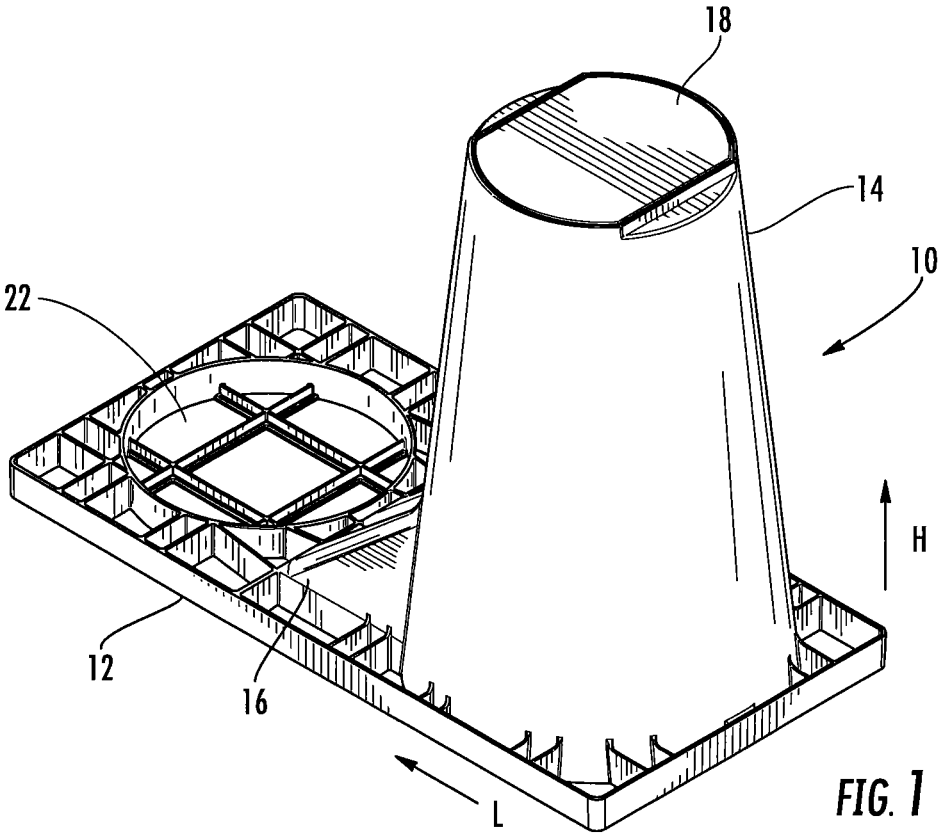
FIG. 1 is a perspective view of a reinforcement unit useful in creating footings for supporting a structure according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Referring now to the figures, a reinforcement unit 10 for creating a footing for supporting a structure, such as a fence post, is illustrated in FIGS. 1-13. The reinforcement unit 10 is described herein in connection with a fence post 30. This particular application is described for exemplary purposes only. The reinforcement unit 10 can be used to construct footings for other types of structures and structural components, such as, but not limited to, light posts, sign posts, guard rail posts, etc. As used herein, the term "structure" is intended to encompass structures and structural components.

The reinforcement unit 10 comprises a base 12 and a tower 14. The base 12 extends in a first direction (L) and the tower 14 extends in a second direction (H) that is generally perpendicular to the base 12. The reinforcement unit 10 may comprise a plurality of reinforcing members 16 attached to the base 12 and the tower 14. These components are described in greater detail below.

The tower 14 defines a cavity 20 (FIG. 7) for receiving a portion of the structure (such as a fence post) that is being supported and an anchoring material. The top portion of the tower 14 has a width or a diameter that is smaller than the width or diameter of the bottom portion of the tower 14. The diameter of the main portion of the tower 14 should be sufficient to permit the main portion of the tower 14 to accommodate the lower portion of the structure that is being supported, e.g., the fence post 30. The optimal length of the main portion of the tower 14 is application-dependent, and can vary with factors such as the amount of force the reinforcement unit 10 needs to produce to counteract bending moments and linear forces on the fence post 30. In some embodiments, the tower 14 is frusto-conical in shape. In alternative embodiments, the tower 14 can have a shape other than frusto-conical, such as cylindrical, rectangular, or the like.

Figure 11:
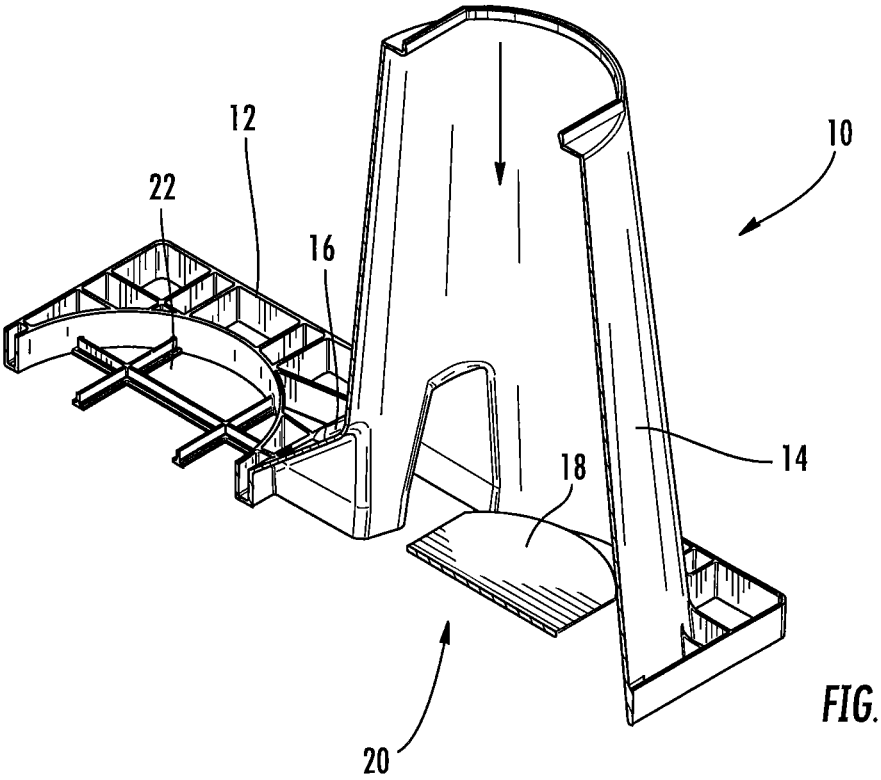
FIG. 11 is a cross-section view of the reinforcement unit of FIG. 1, wherein the cover has been separated from the tower and has fallen into the cavity.

The top portion of the tower 14 may comprise a cover 18. In some embodiments, the cover 18 may be manufactured as a single piece with the tower 14. In alternative embodiments, the cover 18 may be a manufactured as a separate piece. In some embodiments, to facilitate relatively easy separation of the cover 18 from the upper end of the tower 14, the top portion of the tower 14 comprises a frangible section that can break away from the remainder of the tower 14 (FIG. 11). A frangible cover 18 may be attached to the tower 14 via thinned sections, scored sections, discontinuous sections, or the like, that enable it to be easily fractured or broken away from the remainder of the tower 14.

As noted above, the base 12 extends from the tower 14 in a direction (L) substantially perpendicular to the longitudinal axis (H) of the tower 14, i.e., the base 12 and the tower 14 are separated by an angle of approximately ninety degrees. At a section of the base 12 opposite the tower 14 is a pocket 22 (or similar recess). The pocket 22 is substantially similar in width or diameter to the top portion of the tower 14. The size and shape of the base 12 can vary and are application-dependent (for example, the base 12 need not be rectangular). The optimal dimensions of the base 12 can vary with factors such as the amount of force the reinforcement unit 10 needs to produce to counteract external forces on the fence post 30. In some embodiments, the base 12 comprises a grid pattern.

Figure 2:
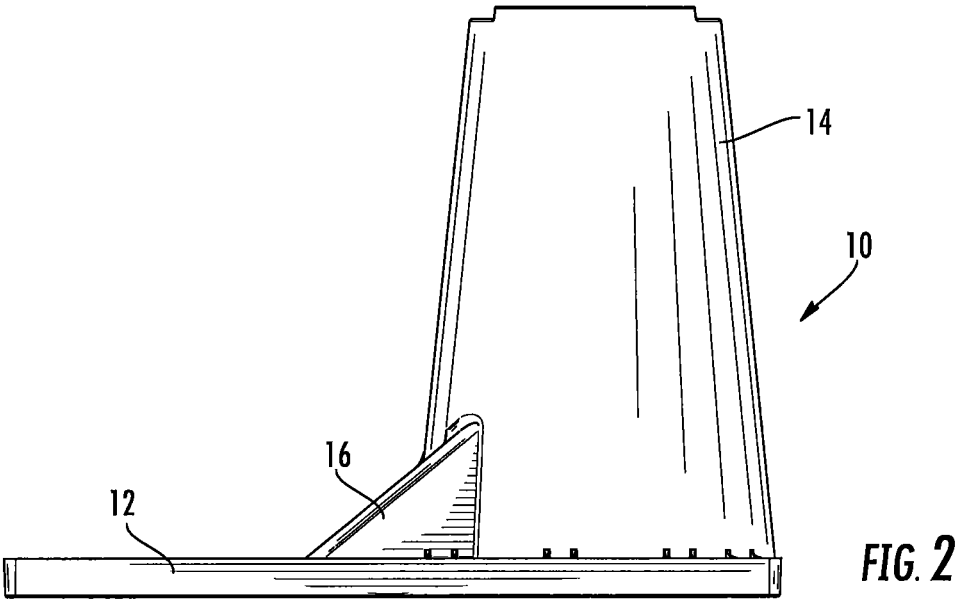
FIG. 2 is a left side view thereof.
Figure 3:
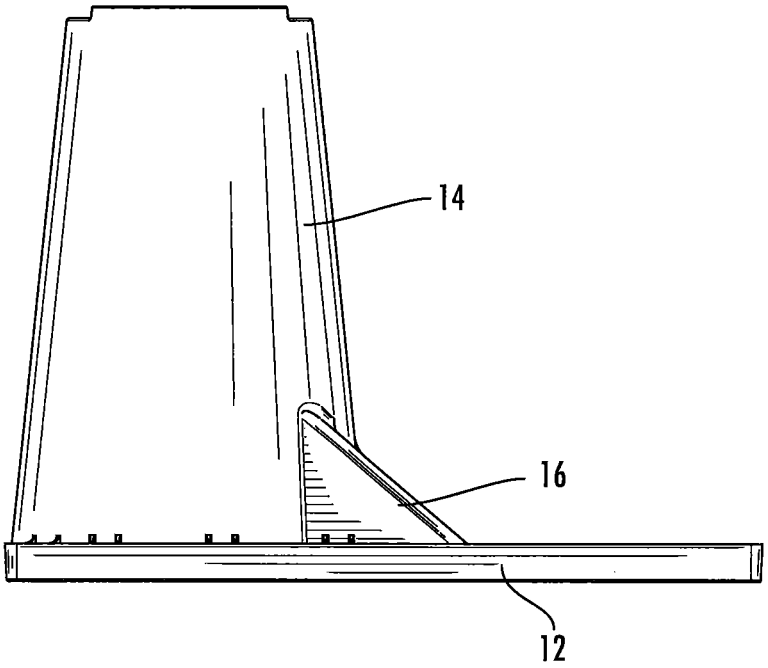
FIG. 3 is a right side view thereof.
Figure 4:
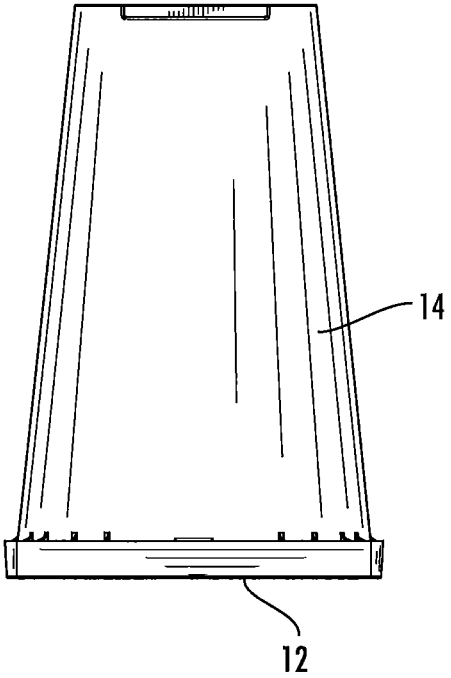
FIG. 4 is a front view thereof.
Figure 5:
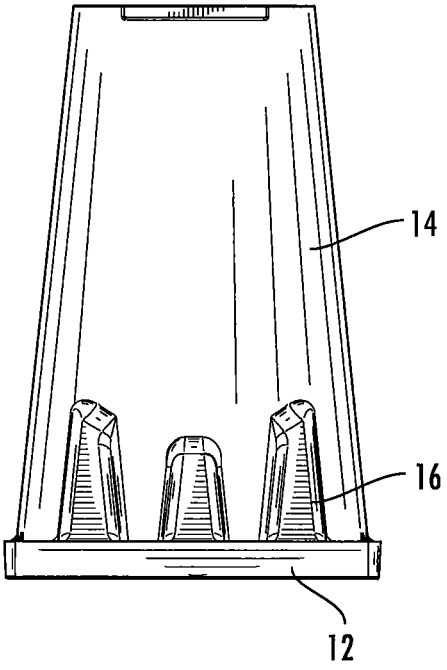
FIG. 5 is a rear view thereof.
Figure 6:
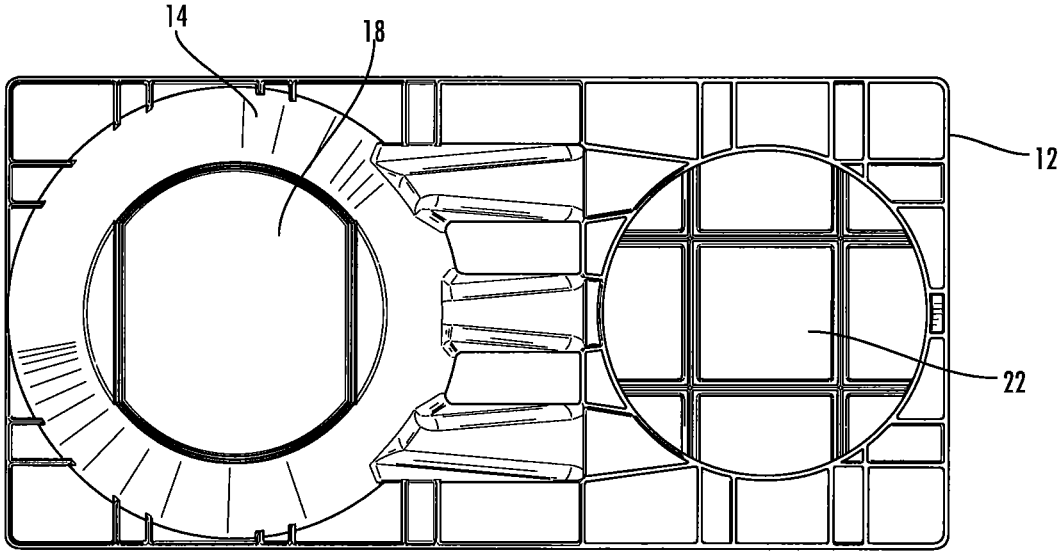
FIG. 6 is a top view thereof.
Figure 7:
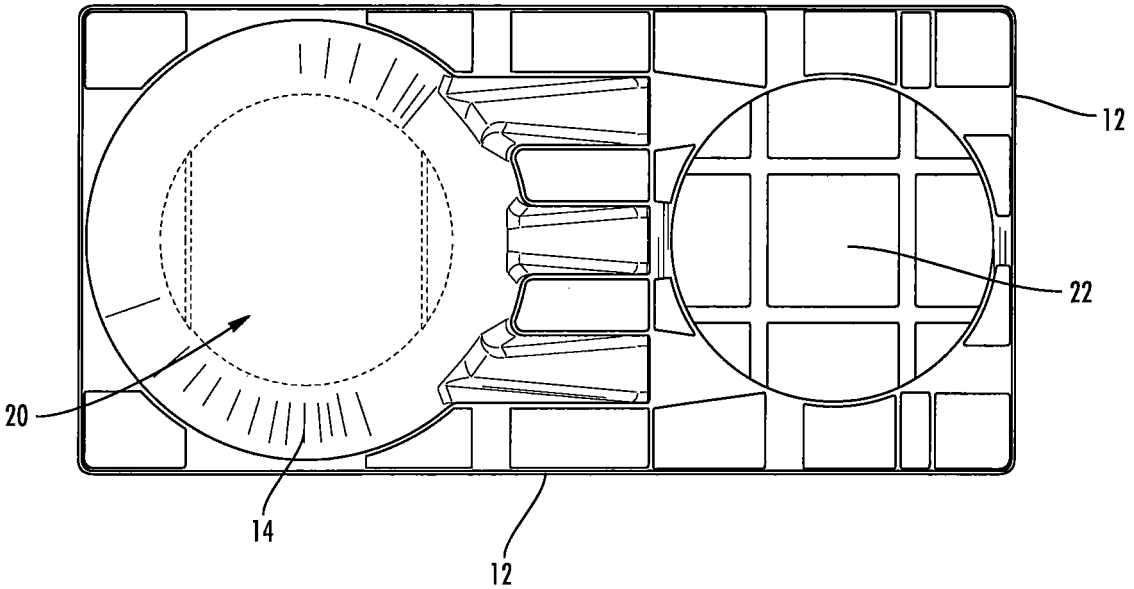
FIG. 7 is a bottom view thereof.

As can be seen in FIGS. 2 and 6, the reinforcing members 16 provide the tower 14 with additional support. The reinforcing members 16 may be formed from the same composition as the base 12 and the tower 14; as such, the composition should have suitable strength to withstand the forces exerted thereon by the fence post 30 and any backfill material 34 placed around the reinforcement unit 10 during installation. In some embodiments, the base 12, the tower 14, and the reinforcing members 16 form a monolithic component.

Figure 8:
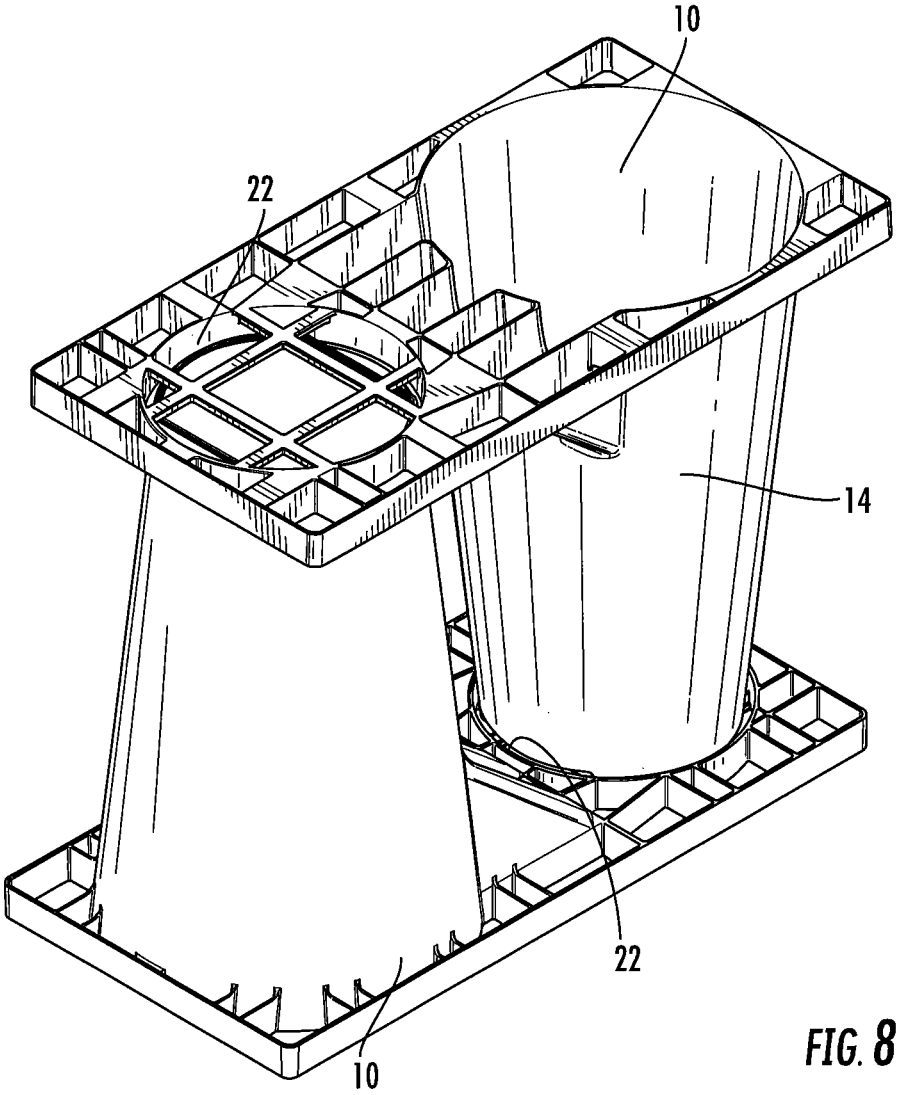
FIG. 8 is a perspective view of two reinforcement units of FIG. 1, wherein one of the reinforcement units is inverted, the two reinforcement units in a stacked configuration suitable for shipping.

The aforementioned pocket 22 may be included to enable a second identical reinforcement unit 10 which can be inverted and stacked on the first reinforcement unit 10. FIG. 8 illustrates how two identical reinforcement units 10 can be stacked on one another, saving space during shipping, thereby allowing the reinforcement unit 10 to be shipped in a relatively space-efficient manner Stacking the reinforcement units 10 in this manner also creates a flat surface allowing additional items to be stacked on top of the reinforcement units 10 during packaging.

Figure 9:
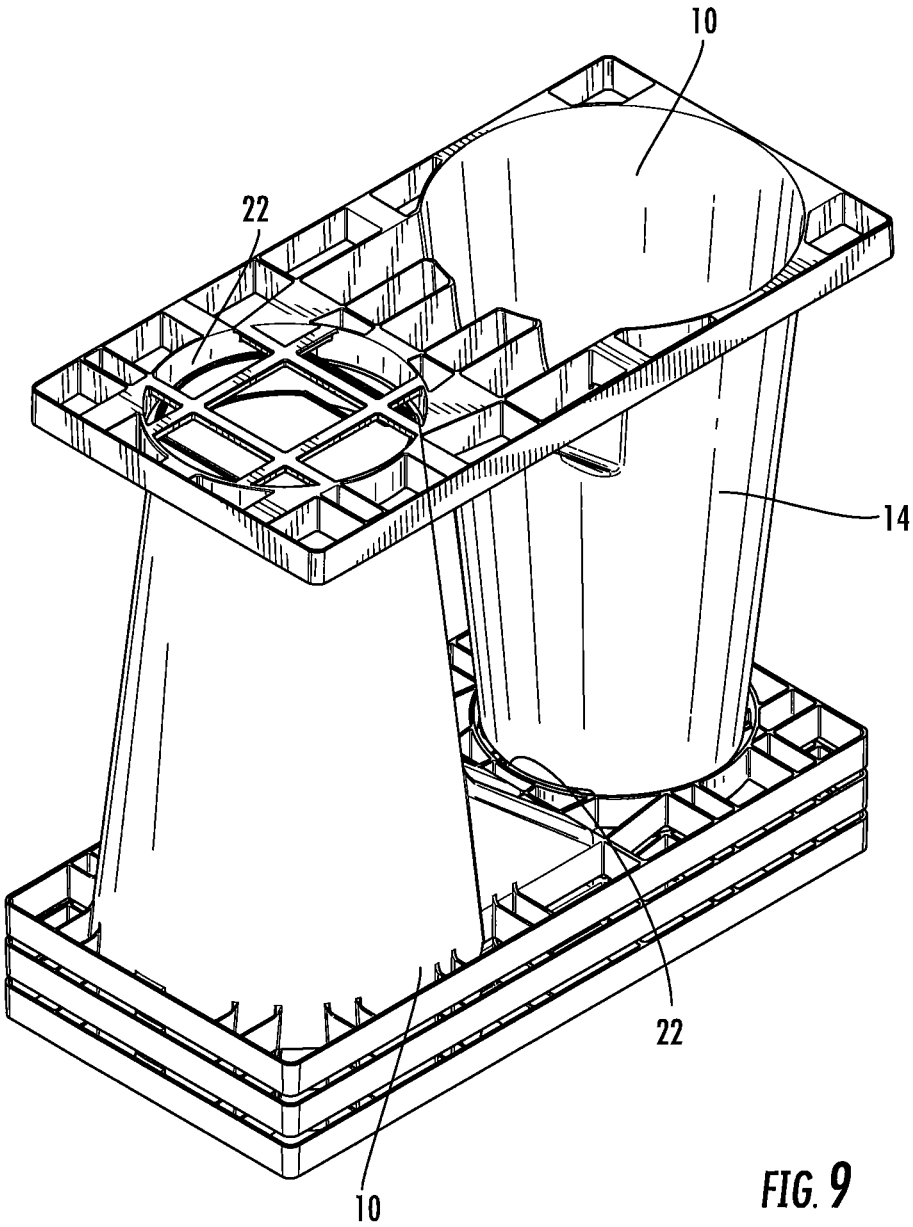
FIG. 9 is a side view of multiple reinforcement units of FIG. 1 in a stacked configuration suitable for shipping.
Figure 10:
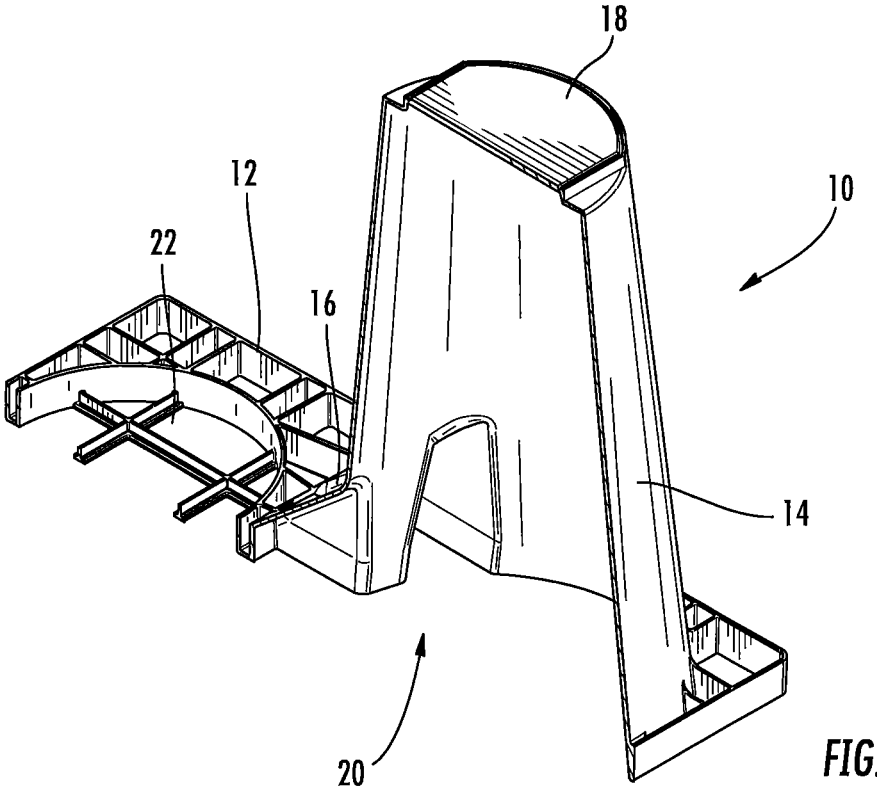
FIG. 10 is a cross-sectional view of the reinforcement unit of FIG. 1.

FIG. 9 illustrates how multiple reinforcement units 10 can also be stacked on top of one another, further saving space during shipping.

Moreover, the inclusion of the frangible cover 18 of the tower 14 can eliminate the problem of lost covers at jobsites and also can facilitate less waste. More specifically, the frangible cover 18 can be punched downwardly; as the cover 18 breaks away, it falls into the cavity 20 of the tower 14, which is subsequently filled with anchoring material. FIG. 11 illustrates the cover 18 falling into the cavity 20 of the tower 14. Because the cover 18 can simply remain with the reinforcement unit 10, it creates no additional waste that must later be disposed.

The reinforcement unit 10 can be formed from a variety of compositions that can withstand a wide range of environmental conditions, such as high density polyethylene (HDPE), rubber or the like, using a suitable process such as injection molding. Other materials and other manufacturing processes can be used in the alternative. In some embodiments, the reinforcement unit 10 is formed from a composition comprising polypropylene and glass. In one embodiment, the reinforcement unit 10 is formed from a composition comprising between about 75% and 95% polypropylene and between about 5% and 25% glass.

The reinforcement unit 10 may be manufactured using a method in which varying thicknesses for the base 12 and tower 14 can be achieved using the same type of molding process. The thickness for a particular application is dependent on the end use of the reinforcement unit 10. Suitable manufacturing processes including, but are not limited to, injection molding, blow molding, extrusion, and thermoforming. The thickness of the tower 14 should be sufficient to withstand the forces generated by the backfill material 34 placed around the tower 14 and compacted during construction of the segmental retaining wall 32 behind which the reinforcement unit 10 can be installed.

Figure 12:
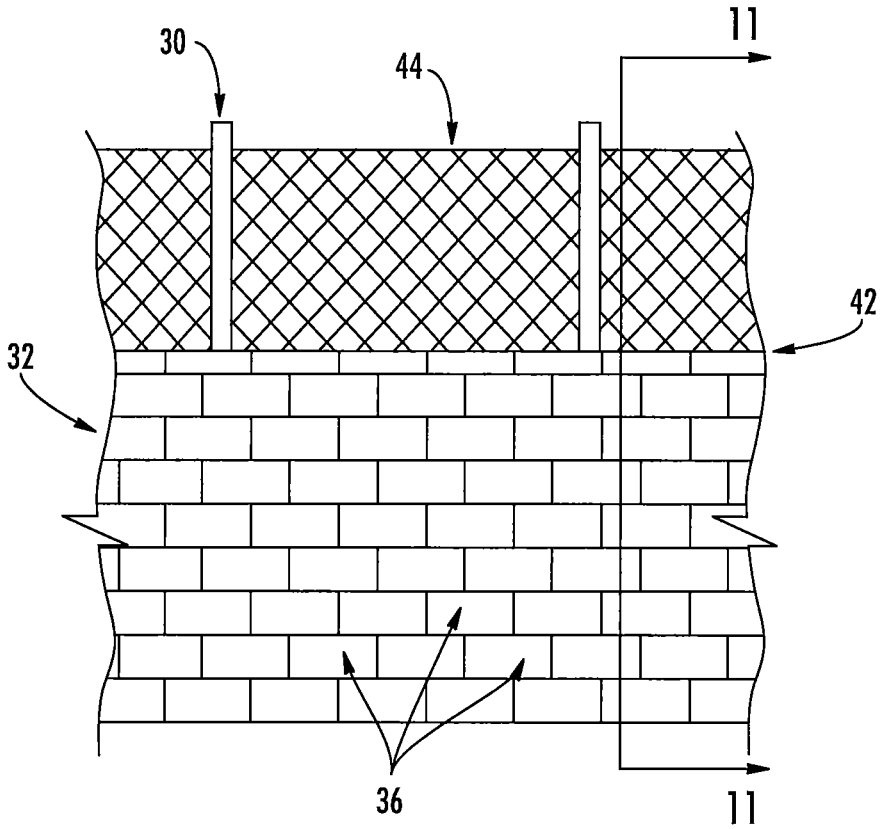
FIG. 12 is a side view of a wall, and a fence having fence post footings supported using the reinforcement unit shown in FIG. 1.
Figure 13:
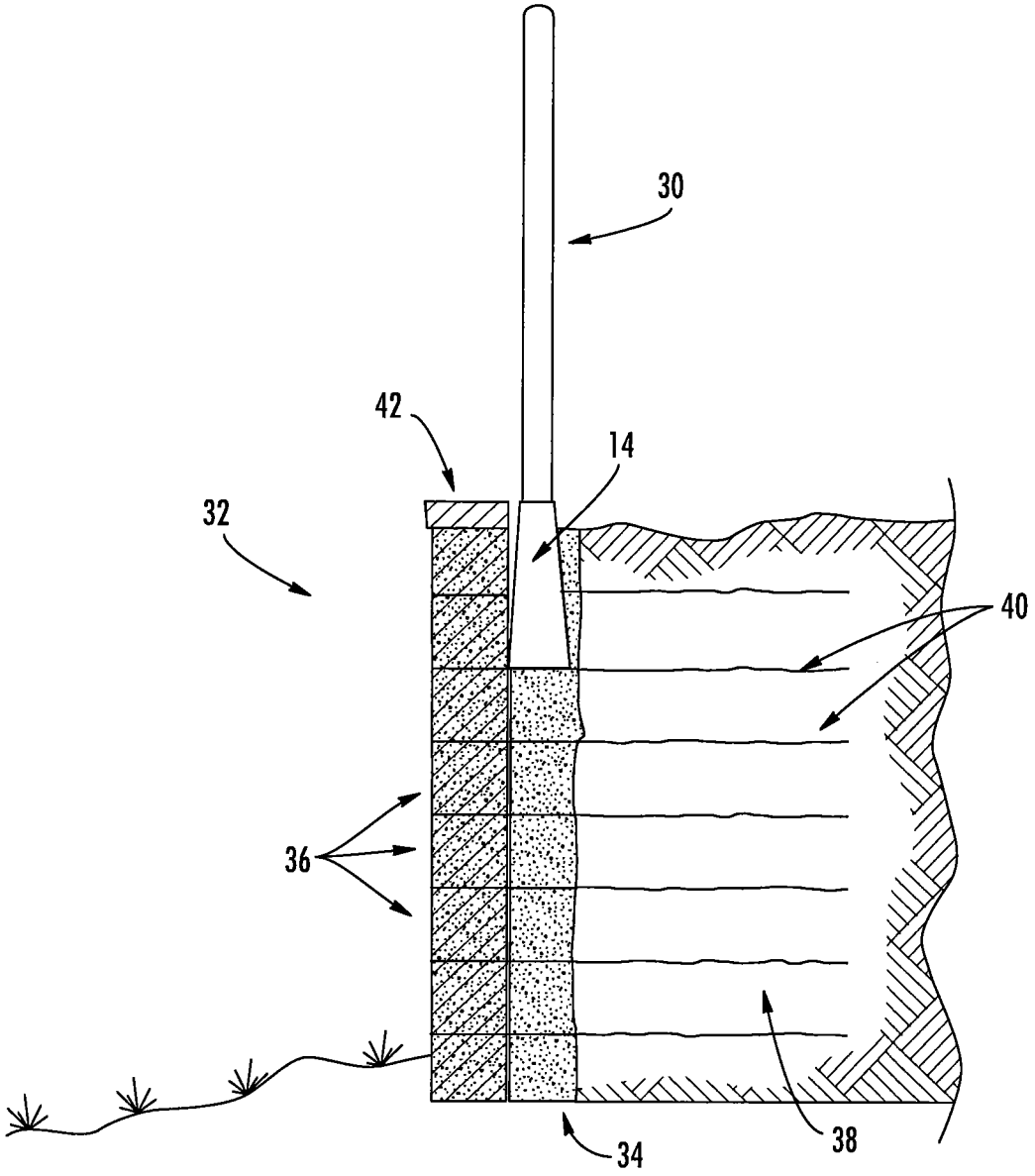
FIG. 13 is a cross-sectional view of a wall, and a fence shown in FIG. 12.

The reinforcement unit 10 can be used to form a footing for supporting a structure, such as the fence post 30, when the fence post 30 is installed behind the segmental retaining wall 32 (FIGS. 12 and 13).

The spacing between adjacent reinforcement units 10 is dependent upon the desired distance (spacing) between adjacent fence posts 30. The cover 18 may have a plurality of notches 24 which may receive the tab (not shown) commonly located on the end of conventional tape measures. At least one of the notches 24 may act as a convenient means for holding the tab at the reinforcement unit 10, as the position of the adjacent reinforcement unit 10 is determined based on measurements obtained from the tape measure.

The segmental retaining wall 32 can initially be constructed in a conventional manner. For example, a trench for receiving a lowermost (base) row of blocks 36 can be excavated along the planned path of the wall 32 (the blocks 36 can be, for example, mortarless concrete blocks). The ground at the bottom of the trench can be stabilized and compacted using a vibrating mechanical plate. The base row of blocks 36 can be placed in the trench and leveled.

The voids in each block 36 can be filled with crushed stone or other suitable material. The area in back of the blocks 36 can be backfilled to the approximate height of the blocks 36 using crushed stone 34 or other suitable material. As used herein, the term "backfill material," refers to filling material, such as crushed stone or soil, used to fill the area behind the wall 32. The area behind the crushed stone can be filled with on-site soil 38. Filling material other than the crushed stone 34 and on-site soil 38 can be used as backfill, in the alternative.

Successive overlying rows of blocks 36 can be formed in a similar manner. A reinforcing tie back subsystem, such as sheets of geogrid 40, can be attached to each row of blocks 36. The sheets of geogrid 40 can extend outward from the blocks 36, onto the adjacent layer of backfill material 34, by a predetermined distance. Each sheet of geogrid 40 should be tensioned before being covered by the overlying layer of backfill material 34.

The reinforcement unit 10 should be installed so that the top of the tower 14 is accessible from above ground after the wall 32 has been completed and back-filled (FIG. 13). The weight of the backfill material 34 acting on the bottom portion of the tower 14 can help to stabilize the reinforcement unit 10 during installation.

The reinforcement unit 10 should be positioned so that the main portion of the tower 14 contacts the adjacent row of blocks 36 (FIG. 13). Positioning the reinforcement unit 10 in this manner can help to minimize the spacing the between the fence post 30 and the wall 32 when the fence post 30 is subsequently installed. Moreover, positioning the reinforcement unit 10 in this manner places all, or at least a portion of the tower 14 on the underlying crushed stone 34.

The remaining rows of blocks 36 and layers of backfill material 34 can subsequently be completed, in substantially the same manner as the previous the rows and layers. Caps 42 can be installed on top of the uppermost row of blocks 36, if desired.

The tower 14 forms a cavity 20 in the backfill material 34. The cavity 20 can accommodate the bottom portion of the fence post 30. The reinforcement unit 10 can remain in place, with the cover 18 installed, until the fence post 30 is about to be installed. The cover 18 can prevent substantial amounts of soil or other debris from falling into the cavity 20 formed by the tower 14 before the fence post 30 is installed. Moreover, the cover 18 can reduce or eliminate the potential for injuries caused by tripping over or stepping into an open hole in the ground. Hence, the cover 18 can be particularly beneficial in applications where the fence post 30 will not be installed immediately upon completion of the wall 32.

As discussed above, in some embodiments, the upper end of the tower 14 comprises a frangible section. This allows a user to easily fracture (i.e., separate) the cover 18 from the upper end of the tower 14. Once separated, the cover 18 can fall into the cavity 24 of the tower 14, thus eliminating additional waste (FIG. 11). Alternatively, the separated cover 18 can be removed and discarded.

After the cover 18 has been punched away and has fallen into the cavity 20, the lower portion of the fence post 30 can be placed in the cavity 20 formed by the tower 14. A suitable anchoring material, such as 3,000 psi concrete, can be poured into the tower 14 after the lower portion of the fence post 30 has been placed therein (FIG. 13). The use of 3,000 psi concrete as the anchoring material is specified for exemplary purposes only. Other types of anchoring materials can be used in the alternative.

The anchoring material fills the cavity 20 formed by the tower 14, and immerses the lower portion of the fence post 30. The anchoring material (e.g., the concrete upon hardening) and the portion of the base 12 immersed in the concrete form a reinforced concrete footing for the fence post 30. The base 12 can interact with the surrounding backfill material 34, e.g., soil, crushed stone, etc., to generate forces that resist bending moments and linear forces on the fence post 30.

Many design codes and site plans require a fence post 30 installed directly adjacent a segmental retaining wall 32 to withstand an applied load of approximately twenty pounds per linear foot of fence 44. The use of the reinforcement unit 10, it is believed, provides the fence post 30 with sufficiently reinforcement to meet this standard.

The use of the reinforcement unit 10, by permitting the fence post 30 (and the associated fence 44) to be installed directly adjacent the wall 32, can obviate the need for a setback between the wall 32 and the fence 44. Hence, the underutilization of real estate, and the potential safety hazard resulting from the use of such setbacks can be eliminated.

Eliminating the need for a setback also can eliminate the potential for mistakenly installing the fence 44 too close to the wall 32 in violation of a design code or site plan. Hence, the potential need to remove and reinstall the fence 44 due to such mistakes can be reduced or eliminated through the use of the reinforcement unit 10. Moreover, the footing support, it is believed, can be constructed without using substantially more concrete than a footing constructed in a conventional manner.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reinforcement unit for creating a footing for supporting a structure, comprising:

a base extending in a first direction; and a tower extending in a second direction from a first end of the base that is generally perpendicular to said base, a top portion of the tower having a width or a diameter smaller than a width or diameter of a bottom portion of the tower, the tower defining a cavity for receiving a portion of the structure and an anchoring material, wherein the portion of the structure is inserted into the cavity by way of a top of the cavity, and the width or diameter of the top portion of the tower is substantially greater than the outer dimensions of the portion of the structure so that the anchoring material can be introduced into the cavity by way of the top of the cavity while the portion of the structure is positioned within the cavity, wherein a second end of the base comprises a pocket substantially similar in width or diameter to the top portion of the tower such that a second identical reinforcement unit can be inverted and stacked on top of the reinforcement unit.

2. The reinforcement unit of claim 1, wherein the base and the tower are formed from a composition comprising about 90% polypropylene and about 10% glass.

3. The reinforcement unit of claim 1, wherein the tower is frusto-conical.

4. The reinforcement unit of claim 1, wherein the base comprises a grid pattern.

5. The reinforcement unit of claim 1, wherein the reinforcement unit comprises a plurality of reinforcing members adjacent to the tower and the base.

6. The reinforcement unit of claim 1, wherein the base and the tower form a monolithic component.

7. The reinforcement unit of claim 1, wherein the top portion of the tower comprises a frangible section.

8. The reinforcement unit of claim 1, wherein two or more of the reinforcement units are stackable on top of one another.

* * * * *